United States Patent [19]

Justal et al.

[11] Patent Number: 4,969,565

[45] Date of Patent: Nov. 13, 1990

[54] INDEPENDENT UNIVERSAL CONNECTOR FOR ENTERAL NUTRITION TUBES

[75] Inventors: Pierre Justal, St-Gratien; Serge Plevin, Gratien, both of France

[73] Assignee: Medical Plastiques, Montlignon, France

[21] Appl. No.: 356,985

[22] Filed: May 25, 1989

[30] Foreign Application Priority Data

May 25, 1988 [FR] France ..... 8806935

[51] Int. Cl.[5] ..... B65D 39/04

[52] U.S. Cl. ..... 215/250; 215/319

[58] Field of Search ..... 215/247, 250, 319, DIG. 3; 220/287

[56] References Cited

U.S. PATENT DOCUMENTS

| | | | |
|---|---|---|---|
| 1,366,789 | 1/1921 | Graham . | |
| 2,457,120 | 12/1948 | Brandon | 215/247 |
| 2,747,756 | 5/1956 | Hartop, Jr. et al. . | |
| 3,019,932 | 2/1962 | Singiser | 215/319 X |
| 3,807,457 | 4/1974 | Logsdon | 220/287 X |
| 3,850,341 | 11/1974 | Bart | 220/212 |
| 4,577,771 | 3/1986 | Martinez | 215/319 |

FOREIGN PATENT DOCUMENTS

| | | | |
|---|---|---|---|
| 1232373 | 4/1960 | France | 215/250 |

*Primary Examiner*—Stephen Marcus

*Attorney, Agent, or Firm*—Browdy and Neimark

[57] ABSTRACT

Device (1) for connecting an enteral nutrition tube (7) to a nutrient composition container and having a neck (8A–8D), of the type comprising a transverse closure wall (4) and a skirt (3) forming with said wall a plug adapted to be fixed to said neck (8A–8B), characterized in that it is independent of the tube (7), in that the transverse closure wall comprises a reduced thickness area (5) adapted to be perforated by a perforator end-piece (6) mounted on one end of said tube, and in that said skirt forms part of a set of at least two coaxial elastic cylindrical skirts (2, 3) fastened to the transverse closure wall and each adapted to engage inside or outside the necks of containers having at least two different predetermined formats.

7 Claims, 2 Drawing Sheets

INDEPENDENT UNIVERSAL CONNECTOR FOR ENTERAL NUTRITION TUBES

Figure 2:
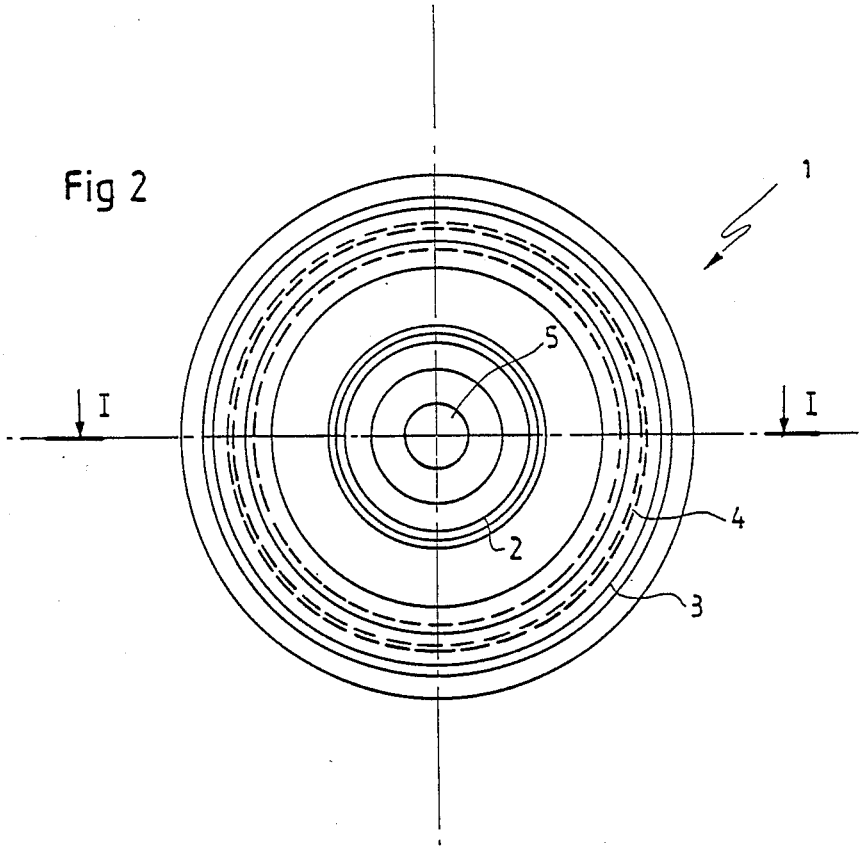

The invention concerns a connector for enteral nutrition tubes.

As is well known, the enteral nutrition of a patient consists in conducting into the stomach or the intestine by means of a probe passed down the oesophagus a nutrient composition packaged in a container situated at a distance and to which the probe is connected by means of a so-called enteral nutrition tube.

There currently exist numerous types of container with necks of different predetermined format, chosen by the manufacturers of nutrient compositions, and to each of these necks, and therefore to each of these types of container, there currently corresponds a specific tube fitted at one end with a connector adapted to cooperate with said neck. In practice a drip chamber is interposed between this connector and the flexible part of the tube.

With a view to standardization, the invention is directed to a connector of the aforementioned type which is adapted to cooperate with a plurality of predetermined neck formats. The benefits of such standardization are to reduce manufacturing costs and to require a reduced number of tubes to be held in stock at each utilization site: this results in a reduced volume of stock and a reduced overall cost of the tubes to be kept in stock.

To this end the invention proposes, for connecting an enteral nutrition tube to a nutrient composition container having a neck, a device of the type comprising a transverse closure wall and a skirt forming with said wall a plug adapted to be fixed to said neck characterized in that it is independent of the tube, in that the transverse closure wall comprises a reduced thickness area adapted to be perforated by a perforator end-piece mounted on one end of said tube, and in that said skirt forms part of a set of at least two coaxial elastic cylindrical skirts fastened to the transverse closure wall and each adapted to engage inside or outside the necks of containers having at least two different predetermined formats, one of the skirts comprising internally a first cylindrical wall adjacent the transverse closure wall and bordered at a distance from the latter by an enteral radially projecting rib so as to be able to fit around a first neck format having an external radially projecting lip and a larger diameter second cylindrical wall joined to the first by a transverse bearing surface and bordered at a distance from the latter by an enteral radially projecting second rib so as to be able to fit around a second neck format of larger diameter than the first and having an external radially projecting rim, the same skirt comprising externally a generally cylindrical wall adapted to penetrate inside the neck of a baby's feeding bottle.

It will be appreciated that the fact that the connector is independent of the rest of the tube facilitates its manufacture and sterile storage while enabling the use of tubes fitted with perforators used in other applications, which reduces the cost price thereof.

According to preferred features of the invention, some of which may be combined with others:

said set of skirts comprises at least a first skirt provided externally with friction ribs and adapted to fit inside a first format of container neck and a second skirt adapted to engage externally over a second format of container neck, the first and second skirts are on the same side of the transverse closure wall, the first format corresponds to a standard format neck of the type adapted to receive standard metal capsules and the second format corresponds to the standard format of transfusion flask neck, there is associated with said skirt, radially inside it, a second skirt adapted to fit inside the smooth neck of a sachet type container.

These latter arrangements enable use with three common formats of container necks.

Further, and advantageously:

said generally cylindrical wall may have a diameter which reduces in the direction away from the transverse closure wall, said transverse closure wall may be delimited externally by a cylindrical wall adapted to pass through a clamping ring of said baby's feeding bottle and joined to the exterior wall of the skirt by an annular flange projecting radially outwards and adapted to be clamped axially between the neck of the baby's feeding bottle and a transverse annular bearing surface of the clamping ring.

Figure 1:
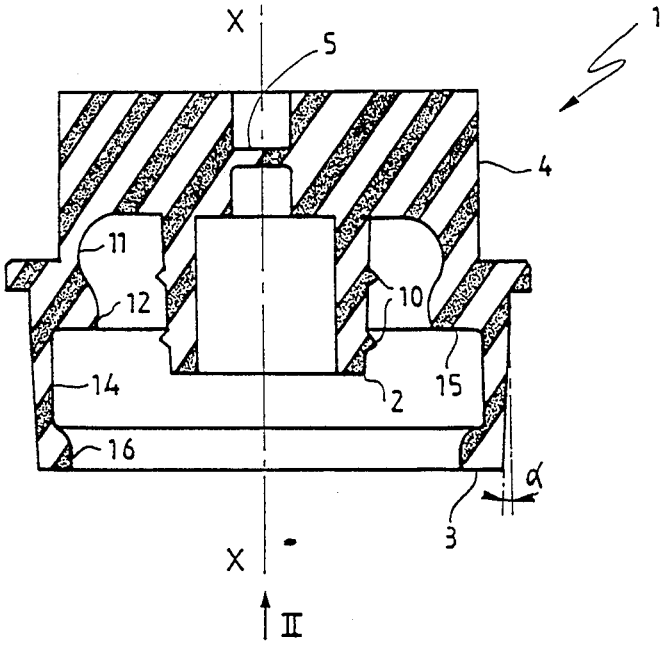
Figure 3:
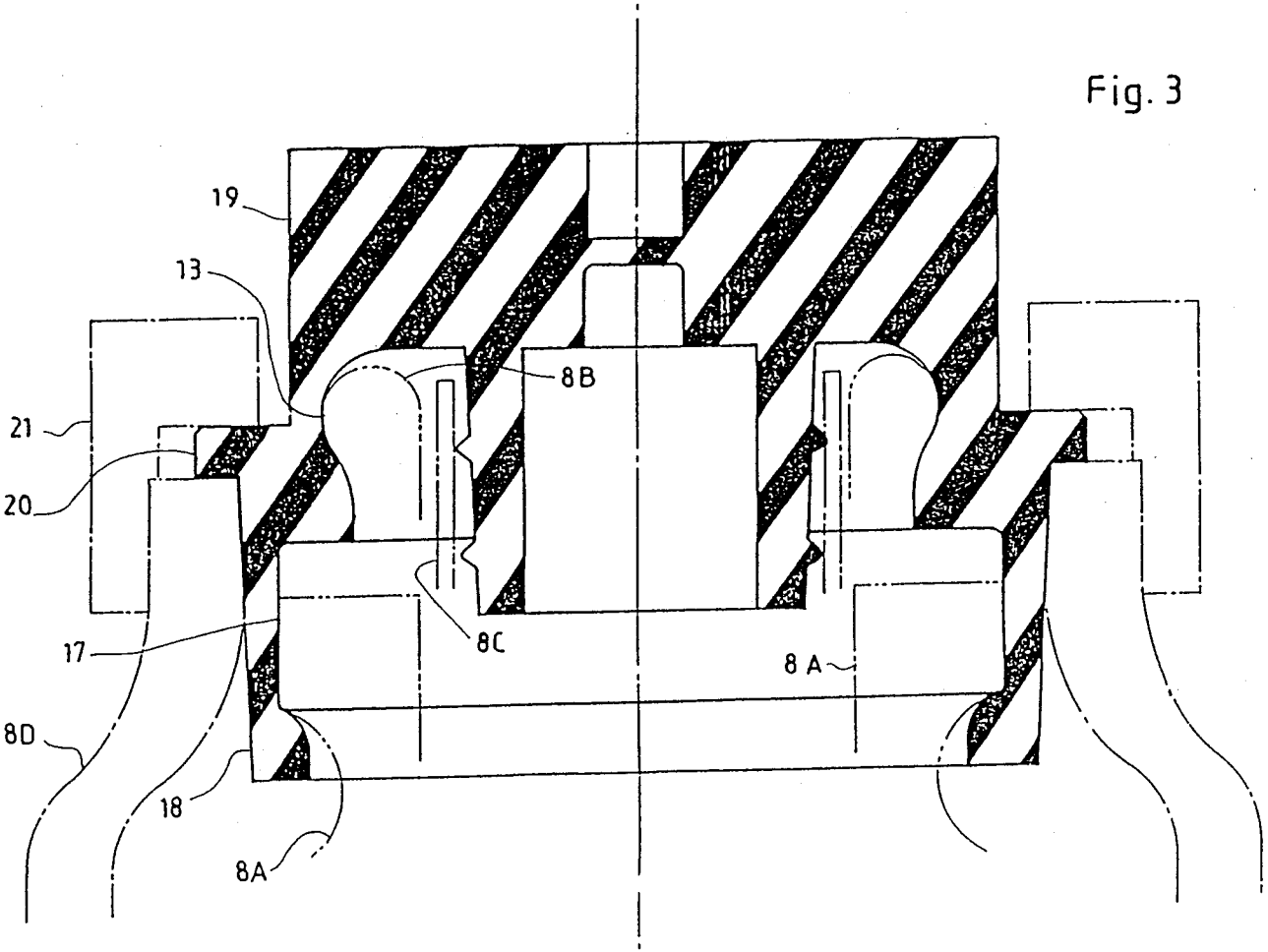
Figure 4:
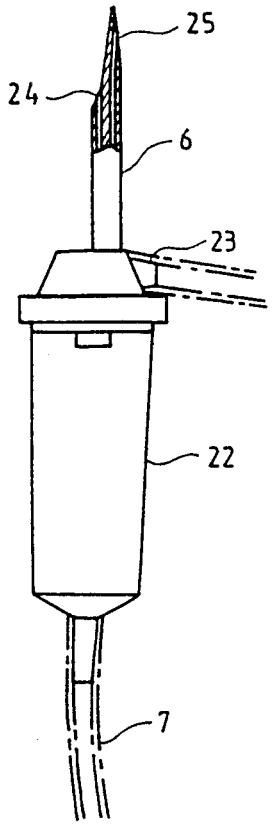

Objects, characteristics and advantages of the invention will emerge from the following description given by way of non-limiting and illustrative example with reference to the appended drawings in which:

FIG. 1 is a view in diametral axial cross-section on the line I-I in FIG. 2 of a connector in accordance with the invention, FIG. 2 is a view of it from below as seen in the direction of the arrow II in FIG. 1, FIG. 3 is an enlarged version of FIG. 1 showing various container necks that can receive the connector; and FIG. 4 is a partially cut away side view of the end of an enteral nutrition tube fitted with a perforator adapted to cooperate with the connector.

The connector 1 shown by way of example in FIGS. 1 through 3 comprises a set of several coaxial, elastic skirts, here, two in number ( references 2 and 3) joined to a transverse closure wall 4 comprising a reduced thickness area 5 here disposed on the axis X-X; this area is adapted to be perforated by a perforator end-piece , that shown at 6 in FIG. 4, for example, mounted at one end of a tube 7 and which the connector 1 is intended to connect to the neck of a container (not shown) containing a nutrient composition. The area 5 is in this instance in the form of a partially closed hole (with a diameter of 4 mm, for example).

The skirts 2 and 3 of this connector are shaped so that each can engage inside or outside necks 8A, 8B, 8C and 8D having different predetermined formats.

In the example under consideration the skirts 2 and 3 are disposed on the same side of the transverse closure wall 4, the skirt 2 being situated inside the skirt 3.

The skirt 2, or enteral skirt, is provided externally with rubbing ribs 10 offset axially by virtue of which said enteral skirt is adapted to fit inside and be retained in the neck 8C. The neck 8C is, for example, a smooth walled cylindrical plastic neck as currently fitted to a flexible sachet type container.

The outside diameter of this wall is 14.2 mm, for example, with ribs projecting 0.5 mm.

The skirt 3, or external skirt comprises internally a first cylindrical wall 11 adjacent the closure wall 4 and bordered at a distance from the latter by an internally projecting rib 12 by virtue of which the first wall can cap a neck 8B provided with a rim 13 under which said rib 12 engages. The neck 8B preferably corresponds to a standard format of bottles adapted to be closed by a metal capsule. The inside diameter of this first wall is in this case 26 mm.

The skirt 3 further comprises, internally, a second cylindrical wall 14 of larger diameter than the first, joined to the first by a transverse bearing surface 15 and bordered at a distance from the latter by a second internally projecting rib 16 by virtue of which this second wall can cap a neck 8A provided with a rim 17 under which said rib 16 locates. This neck 8A preferably corresponds to the standardized format of transfusion flask necks. There are available nutrient preparations packaged in containers provided with such necks. The inside diameter of the second cylindrical wall is in this case 30.5 mm, for example.

The external skirt advantageously comprises externally a generally cylindrical wall 18 adapted to enter the neck 8D of a container, a baby's feeding bottle, for example. To facilitate the entry of the -connector into the baby's feeding bottle, the external wall 18 is slightly tapered with, in this example, a diameter reducing from 34 mm near the transverse wall 4 to 33 mm at a distance of 23 mm from the latter.

In combination with this external wall 18 there is advantageously provided a cylindrical wall 19 bordering radially the transverse closure wall 4 while a flange 20 projecting radially outwards is provided longitudinally between the walls 18 and 19. The flange 20 is adapted to be pressed axially against the neck 8D by the transverse bearing surface 21A of a clamping ring 21 associated with the baby's feeding bottle, encircling laterally the transverse closure wall 4.

It goes without saying that the foregoing description has been given by way of non-limiting illustrative example only and that numerous variations may be proposed without departing from the scope of the invention. For example, depending on the format of the necks to which the connector is to fit it is possible to provide complementary skirts disposed externally of the skirts 2 and 3 or on the opposite side of the transverse closure wall.

As seen in FIG. 4, the perforator 8 provided at one end of the tube is generally separated by a drip chamber 22 fitted with an air intake 23. In the perforator endpiece 8 are two longitudinal channels 24 and 25 respectively connected to the interior of the chamber 22 and to the intake 23.

The material from which the connector is made is of any appropriate type compatible with medical requirements.

The wall of the enteral skirt equipped with the ribs 10 is advantageously frustoconical and if appropriate the external skirt may incorporate perforations.

I claim:

1. Device for connecting an enteral nutrition tube to a nutrient composition container having a neck of one of a plurality of at least three predetermined neck types, including a first neck type having an external radially projecting lip, a second neck type of a larger diameter than said first neck type having an external radially projecting rim, and a third neck type identical to a neck of a baby's feeding bottle, said device comprising a plug independent of said enteral nutrition tube adapted to be mounted on anyone of said plurality of predetermined neck types, said plug comprising:

a transverse closure wall adapted to close any one of said plurality of predetermined neck types and comprising a reduced thickness area adapted to be perforated by a perforator end-piece mounted on one end of said enteral nutrition tube;

a plurality of at least two coaxial elastic cylindrical skirts, integral with said closure wall, a first one of which comprising internally a first inner cylindrical wall adjacent said transverse closure wall and bordered axially at a distance from said closure wall by an enteral radially projecting rib so as to be able to fit around a neck of said first neck type, a second inner cylindrical wall of larger diameter than said first inner cylindrical wall connected to said first inner cylindrical wall by a transverse bearing surface and bordered axially at a distance of said transverse bearing surface by a second enteral radially projecting rib so as to be able to fit around a neck of said second neck type, said first skirt further comprising externally a generally cylindrical outer wall adapted to fit inside a baby's bottle's neck of said third neck type.

2. Device according to claim 1, wherein said plurality of skirts further comprises within said first skirt, a second skirt provided externally with friction ribs and adapted to fit inside a neck of a fourth neck type.

3. Device according to claim 2 wherein said first and second skirts are on a same side of said transverse closure wall.

4. Device according to claim 1 wherein said first neck type is adapted to receive standard metal capsules and said second neck type is a transfusion flash neck type.

5. Device according to claim 1 wherein radially within said first skirt, there is a second skirt adapted to fit inside a neck of a sachet type container.

6. Device according to claim 1 wherein said generally cylindrical outer wall has a diameter which reduces away from the said transverse closure wall.

7. Device according to claim 1 wherein said transverse closure wall is delimited externally by a cylindrical wall adapted to pass through a clamping ring of a baby's feeding bottle and connected to said generally cylindrical outer wall by an annular flange projecting radially outwards and adapted to be clamped axially between said neck of the baby's feeding bottle and a transverse annular bearing surface of said clamping ring.

* * * * *